United States Patent [19]

Mason et al.

[11] 3,949,150

[45] Apr. 6, 1976

[54] DRILLING STRING SHOCK-ABSORBING TOOL

[76] Inventors: Leonard Mason, 9230 - 58 Ave.; Clifford Anderson, 6024 - 87 St., both of Edmonton, Alberta, Canada

[22] Filed: July 11, 1974

[21] Appl. No.: 487,564

[52] U.S. Cl. ..... 175/321; 64/23

[51] Int. Cl.[2] ..... E21B 17/042

[58] Field of Search ..... 64/23, 1 V; 175/321, 293, 175/296, 299

[56] References Cited

UNITED STATES PATENTS

| | | | |
|---|---|---|---|
| 2,240,519 | 5/1941 | Reed | 175/321 |
| 2,991,635 | 7/1961 | Warren | 64/23 |
| 3,254,508 | 6/1966 | Garrett | 175/321 X |
| 3,301,009 | 1/1967 | Coulter | 175/321 X |
| 3,345,832 | 10/1967 | Bottoms | 175/321 X |
| 3,383,126 | 5/1968 | Salvatori et al. | 175/321 |
| 3,400,558 | 9/1968 | Haines | 64/23 |
| 3,406,537 | 10/1968 | Falkner | 64/23 |
| 3,472,326 | 10/1969 | Sutliff et al. | 175/299 |
| 3,539,026 | 11/1970 | Sutliff et al. | 175/299 |
| 3,660,990 | 5/1972 | Zerb et al. | 175/321 X |

FOREIGN PATENTS OR APPLICATIONS

| | | | |
|---|---|---|---|
| 220,470 | 8/1924 | United Kingdom | 175/293 |
| 263,524 | 6/1970 | U.S.S.R. | 175/321 |

*Primary Examiner*—David H. Brown
*Attorney, Agent, or Firm*—E. Peter Johnson

[57] ABSTRACT

A shock absorbing tool is provided having a low spring rate deformable element disposed in an oil bath in a sealed, annular chamber formed between the barrel and mandrel. One of the chamber seals is a floating seal, exposed to the drilling fluid outside the tool so that the pressure within the chamber is equalized with the hydrostatic bottom hole pressure. As a result, the tool is not pre-loaded, when lowered to the bottom of the well bore, leaving the most effective shock-absorbing capability of the element available to absorb the axial thrusts of the drilling bit.

11 Claims, 21 Drawing Figures

DRILLING STRING SHOCK-ABSORBING TOOL

FIELD OF THE INVENTION

This invention relates to a tool for use in a drilling string. More particularly, it relates to a tool having utility for absorbing shock loading arising from axial displacement of the bit during drilling operations.

BACKGROUND OF THE INVENTION

When a drilling bit is rotating on the bottom of a well bore, it is constantly bouncing up and down. A commonly accepted explanation for this action is that the threecone bit forms three lobes on the bottom of the well bore - as the bit moves over these lobes, it is axially displaced three times during each rotation.

Acceleration of the bit off bottom causes high loading of the drilling string. More particularly, the bit has a load on it arising from the weight of the drilling string. For example, the string might weight 120,000 pounds, of which 60,000 pounds might be held suspended by the rig; the remaining 60,000 pounds would bear on the bit. When the loaded bit is accelerated off bottom through a travel of perhaps ½ inch to 1 inch, the essentially rigid drilling string above the bit is subjected to a very high shock load, which is immediately relieved as the bit begins to return to bottom. By way of example, this cyclic loading on the drilling string may vary between 0 and 100,000 pounds or more from one moment to the next.

There are several deleterious effects which arise from the severe cyclic loading to which the drilling string is subjected. For example, it is a prime factor in the wear and failure of the drilling string. It also punishes the rig; particularly rough drilling, the whole rig structure is shaken violently and the only course of action available to relieve the vibration is to reduce the rotational speed of and/or weight on the bit. This causes a reduction in the drilling rate.

It has long been common in the industry to insert a tool, known as a vibration damper or shock absorber, in the drilling string above the bit with the aim of isolating the string from the bit.

In general, a typical vibration damper would comprise an inner, tubular mandrel, attached at its upper end to the drilling string, and an outer, tubular barrel attached at its lower end to the bit, or the collars which are directly above the bit. The mandrel slides or telescopes within the barrel. The two parts are connected by means, such as a spline assembly, so that they are locked for rotation together but can move longitudinally relative to each other. Means are also provided to limit the extent of longitudinal movement of the parts so that they cannot separate one from the other. In one basic type of tool, a portion of the mandrel is reduced in outside diameter so that an annular chamber is formed between the mandrel and barrel. O-ring seals are provided between the mandrel and barrel at each end of the chamber to prevent drilling mud from entering therein. The mandrel and barrel carry opposed upper and lower compression shoulders respectively; these shoulders extend transversely into the annular chamber adjacent its upper and lower ends. A deformable element is provided within the chamber between the compression shoulders.

In operation, when the bit is accelerated upwardly, the barrel compression shoulder acts against the base of the deformable element. The element is prevented from moving axially by the mandrel compression shoulder located at its other end. As the shoulders squeeze together, the element is deformed. In theory, the deformable element should absorb the axial thrust of the bit and prevent the shock load from being transmitted to the drilling string. In practise, this is usually not the case, for reasons which will now be discussed.

The prior art tools can be divided into three types.

In the first type, the O-ring seals are fixed in the wall of the barrel at each end of the deformable element chamber. As a result, the well bore hydrostatic pressure acting on the tool forces the barrel upwardly against the deformable element with a force equal to said pressure times the difference in cross-sectional area of the two seals. To try to cope with this "pre-loading" action which takes place when the tool is in the well bore but before drilling commences, it is conventional to use a "hard" deformable element in the chamber. By a hard element is meant an element having a spring rate of at least 100,000 pounds/inch, usually in the order of 150,000 – 250,000 pounds/inch, where the spring rate is described as the load required to deflect the tool an inch. In these prior art tools, the tool may telescope ¾ inches with a load of 100,000 pounds, but will telescope less than ¼ inch with the next 100,000 pounds. In effect, the tool becomes extremely hard or rigid as the load increases. According to our calculations, in deep wells the deformable element in this type of tool will have lost any shock absorbing capability it had by the time that the tool is at total depth, even before drilling commences. For example, if one were to consider a 12,000 foot deep well bore containing a tool having a differential in seal area of 30 inches, the upward thrust on the barrel created by the hydrostatic pressure could be in the order of 300,000 pounds. In this circumstance, the deformable element would essentially be rigid and ineffective since the tool would have collapsed through most of its stroke. It is evident that in these tools, an element that is relatively soft at the surface would be extremely hard at operating depth due to the very high "pre-load" that it would carry.

The second type of tool is disclosed in Canadian Pat. No. 837,970, issued to Faulkner. In this tool, a floating seal is provided at the base of the deformable element chamber to equalize the pressure internal of the chamber with the bottom hole hydrostatic pressure. However, Faulkner teaches combining this feature with compressible, metal wire elements which are hard elements to begin with and which rapidly pack in use and form virtually non-deformable elements having little shock-absorbing capability. The element taught by Faulkner also has the disadvantage that it is in contact with both the walls of the chamber, thus tending to prevent axial movement of the telescoping tool parts, as the element packs in the chamber.

The third type of tool attempts to provide a relatively "soft" element in the chamber, i.e. one having a low spring rate, and couples it with means for equalizing the pressure within the chamber with the well bore pressure. This tool is described in Canadian Pat. No. 826529, issued to Galle. It involves providing a sealed zone, filled at surface with compressible gas at a predetermined pressure, in the chamber. The chamber is filled with operating oil and a membrane is provided to segregate the gas from the operating oil. A bag, or membrane, open to the well bore, extends into the oil-filled section of the chamber. The chamber is sealed at each end with fixed O-ring seals. Expansion of the bag with the well bore fluid pressurizes the oil and, in turn, the shock-absorbing, compressible gas. However, the pressure and thus the spring rate of the gas body must be varied significantly as the tool is used at different depths. Published reports show that at a depth of 16,000 feet and a bit weight of 80,000 pounds, the spring rate of this device is about 140,000 pounds per inch, while at a depth of 3,000 feet at the same bit weight, the spring rate is about 60,000 pounds per inch. Therefore at the deeper depth, this tool has a "hard" element with a high spring rate, while at the shallow depth, the element can be classed as being moderately soft with a moderate spring rate.

A characteristic of most shock absorbing elements which rely on deformation of a material to absorb shock is that the spring rate of the element increases as the load on the element is increased. In other words, with low loading on an element, the element is much softer than with high loading. The graph illustrated in FIG. 15 shows the deflection-load characteristics in curve form for three elements A, B, and C. As is evident from the graph, the spring rate of the elements (i.e. the slope of the curve) varies continuously as the load on the element changes. Consequently, we must refer to the spring rate as being an average figure for a certain amount of deflection. We describe the spring rate as the load required to deflect the tool one inch.

Element A of the graph can be classified as being hard, having a spring rate for its first inch of travel of about 300,000 pounds per inch. If, at operating depth, the element was pre-loaded, (operating point X on the graph), with 300,000 pounds as described earlier, it is evident that the element would be extremely hard.

Element B of the graph can be classified as being moderate, having a spring rate of 55,000 pounds per inch for its first inch of travel. If at operating depth, the element was pre-loaded (operating point X on the graph) to 300,000 pounds, it is evident that the element would be extremely hard, i.e. it would take an enormous load to further deform the element. If at operating depth, the element was only pre-loaded to 30,000 pounds (operating point Y on the graph), then the element would be moderately soft, having a spring rate of about 60,000 pounds per inch. It could be further deformed, with a relatively small load.

Element C of the graph can be classified as being soft, having a spring rate of 15,000 pounds per inch for its first inch of travel. At operating point X on the graph, the spring rate would be very high and the element would be extremely hard. However, at operating point Y, the element would have a spring rate of about 20,000 pounds per inch.

SUMMARY OF THE INVENTION

In order to provide a shock absorbing drilling tool which will remain relatively soft at all well bore depths and for various bit weights and pump pressures, it is necessary to provide a soft deformable element in combination with a tool assembly adapted, when subjected to well bore hydrostatic pressure, to produce low preloading of the deformable element.

The latter may be attained in the following manner: the mandrel and barrel are formed to provide a chamber therebetween, said chamber containing the deformable element and a body of operating liquid. The chamber is sealed at each of its ends. Means are provided to equalize the pressure within the chamber with the bottom hole pressure, and thereby reduce or eliminate pre-loading. One such means comprises providing a "floating" seal, exposed to the well bore fluid, at one end of the chamber to pressurize the chamber contents.

The deformable element is adapted to permit of a relatively large amount of telescoping action by the tool. More particularly, the element chosen must have a relatively low spring rate, that is its spring rate should be less than 100,000 pounds per inch. In a preferred embodiment, the element is adapted, when operational in the tool, to permit at least two inches of telescoping movement by the tool when the latter is loaded with 80,000 pounds. It is assumed that the tool assembly will be designed to permit at least two inches of tool travel to occur — however the tool could be designed to have a lesser travel before its telescoping parts contact to limit further movement. For example, the tool travel could be limited to 1½ inches; however, the type of element used should meet the criteria that it is capable of permiting at least two inches of tool travel with 80,000 pounds load. What we are trying to say here is that the desired qualities of the deformable element in the context of this invention are conveniently determined when the element is operating within the environment of the tool chamber. These characteristics of the element are defined in the claims in terms of the capability of the element when operative in the tool, i.e. in terms of its capability for permitting a minimum tool travel (2 inches) at a particular tool loading (80,000 pounds). However, we do not intend that the claims be interpreted to require that the tool must have the capability of closing at least two inches, although this is desirable — as stated, a tool loaded with the desired type of element but having a stroke less than two inches could be operated with many of the advantages of the invention.

In order to meet the criteria for element design previously described, it is found that a relatively long element is required. The element may consist of a single, long, annular body — however it is preferred that the element comprise a stack of element segments as further explained below. In our tool, an element of 40 inches length is used. It is also preferred to provide deformable segments which are maintained out of contact with the walls of the annular element chamber, which walls move relative to one another. In the most preferred embodiment, the element consists of a stack of alternating elastomeric rings and lipped steel rings. The steel rings distribute the load to the elastomeric elements while the lips on the steel rings substantially prevent deformation of the elastomeric material at the contact surface with the steel rings. This arrangement also serves to prevent the elastomeric material from contacting the chamber walls as deformation and resulting bulging of the elastomeric segments occurs. It has been found that if the elastomeric deformable segments of the elements are allowed to contact the chamber walls during operation of the tool, rapid destruction of the elastomer occurs in the area of contact. Also, the characteristics of the tool are changed due to the friction generated by the elastomer contact with the moving surfaces of the chamber walls. The steel rings are also provided with an inside diameter significantly larger than the wash pipe diameter and an outside diameter significantly smaller than the barrel diameter, so that neither the steel rings nor the elastomeric rings contact the walls of the annular chamber to any substantial extent.

Other configurations of elements and element segments can, of course, be used.

A problem which often arises with drilling string shock absorbing tools is that when they are used in a drilling string above the bit, they cause the well bore being drilled to deviate from the vertical. Often this problem is caused by a lack of lateral rigidity of the tool as a result of the telescoping elements not performing as an integral unit. We refer to this lack of stability; it results in the portion of the tool attached to the bit moving one way while the portion of the tool attached to the drill collars moves another way.

In a preferred feature, we have provided in our tool a high degree of stability by providing effective contact between the mandrel and barrel at three bearing locations spaced along the length of the tool. Since the tool utilizes a relatively long element chamber, two of these bearing locations are provided immediately above and below the chamber, to stabilize the mandrel. This stability arises from providing an interference fit between the mandrel and barrel at the bearing locations. Preferably, the combination of a clearance of about 0.002 inches between the steel surfaces and the provision of a hard elastomeric ring in one of the surfaces is used to create the necessary liquid-tight fit. This arrangement is effective to minimize differential lateral movement between the telescoping members at the bearing locations. In the tool, passage means are provided in or between the telescoping parts where required to allow the operating fluid to bypass the liquid-tight fit of the elastomeric ring. These grooves may be sized to be restrictive, so that the operating fluid flowing back and forth tends to dampen the telescoping movement. It will be noted that the stabilizing ring can be formed of other materials, such as phosphor bronze or berillium copper, to substantially prevent differential lateral movement. The bypass means may be flutes or bores.

A further problem which is inherent in drill string shock absorbing tools relates to the rotary locking mechanism, which is normally a male and female interlocking spline system. The spline systems in prior art tools are found to wear rapidly as a result of the continuous relative motion between the driving surfaces. These surfaces are subjected to relative sliding motions in the order of 10,000 to 20,000 times per hour. It is found that the conventional steel splines of prior art devices rapidly wear out, even when operating in an oil environment and when experiencing relatively small differential movement.

In the present tool, due to the relatively large telescoping movement allowed for, and in order to reduce the rapid wearing of the splines as experienced in prior art devices, we have found it desirable to provide a novel spline system. This preferred system is comprised, in one embodiment, of rotary, interlocking, telescopically related male and female splines, in which the female spline is provided with a relatively hard, abrasion-resistant, elastomeric material on its driving and backlash surfaces and in its spline roots and crests. In the elastomeric driving surfaces of the female spline, oil pockets and grooves are provided to ensure lubrication of the mating male and female spline surfaces as they move relative to each other. Other arrangements of the novel spline system could provide the same function, such as providing the elastomeric driving and backlash surfaces on the male portion of the spline unit. Also, flutes are provided in the roots of the male spline to allow free movement of the operating liquid.

A tool is therefore provided which incorporates a combination of three features, as follows: (1) deformable element means which are resilient, substantially noncompressible and which have a spring rate of less than 100,000 pounds/inch; (2) said element means being provided in the tool in a sealed chamber which also contains a bath of operating liquid; and (3) means for pressurizing the operating liquid in the chamber, and thus the element means, to substantially equalize the internal chamber pressure with the hydrostatic bottom hole pressure. In preferred embodiments, the element means is formed of non-metallic material which permits at least 2 inches of telescoping tool movement with an axial load of 80,000 pounds and not more than 2 inches of tool movement with a load of 10,000 pounds. In addition, the element segments are adapted to prevent the deformable material from contacting the walls of the tool chamber.

Because the pressure in the chamber is equalized with the hydrostatic bottom hole pressure, no significant preloading of the deformable element takes place. The full range of deformability of the element is therefore available to cope with and absorb the bit-induced axial movement of the barrel. Since the greatest amount of deformation inherent in the elements is available in the 0—40,000 pound load range, the tool is able to absorb most if not all the axial movement of the barrel before the element stiffens to a substantially rigid condition, with the result that the drill string is protected from large shock loads.

DESCRIPTION OF THE PREFERRED EMBODIMENT

According to the present invention, the improved drilling string vibration damper comprises a telescoping mandrel and barrel having a deformable element acting therebetween. The deformable element is adapted to provide a low spring rate shock absorption means. The mandrel and barrel combine to form a plurality of interconnected chambers or a space filled with a body of relatively non-compressible operating fluid. The chambers are separated by close fitting bearing surfaces providing axial stability between the mandrel and barrel. The bearing surfaces are provided with passageways for movement of fluid from one chamber to another. The mandrel and barrel are sealed together at each end of the chamber system by liquid tight seal means therebetween, with one end being provided with a movable seal element to prevent well bore fluid from entering the chamber system and to pressurize the operating liquid therein to equalize it with the hydrostatic bottom hole pressure.

Figure 1A:
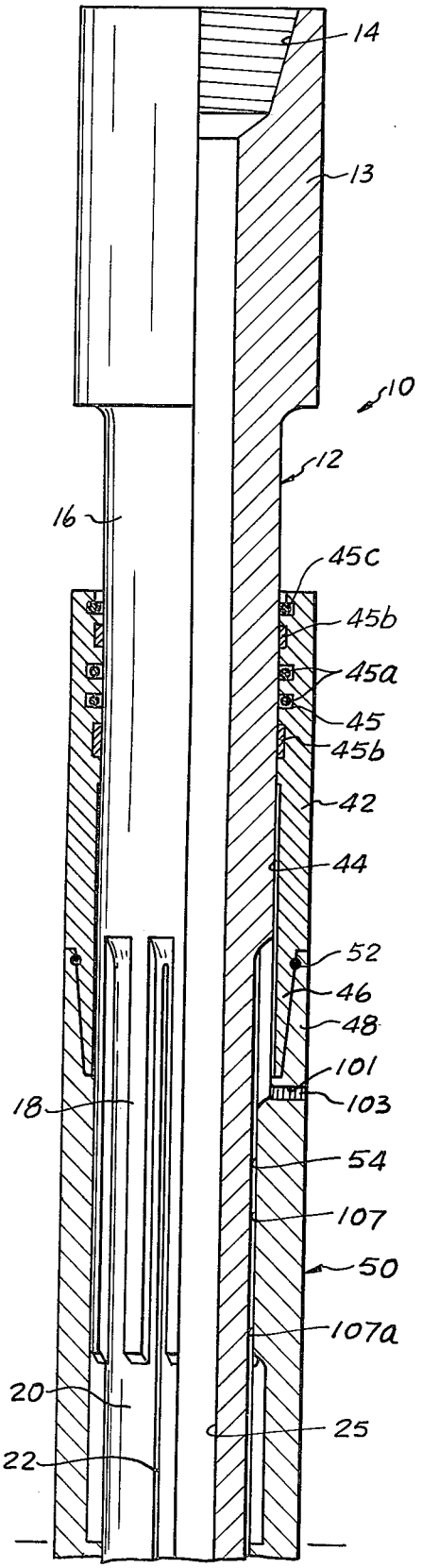
FIGS. 1*a*, 1*b* and 1c are views in three parts in elevation of one embodiment of the drilling string vibration damper according to the present invention in its unloaded or extended condition.
Figure 1B:
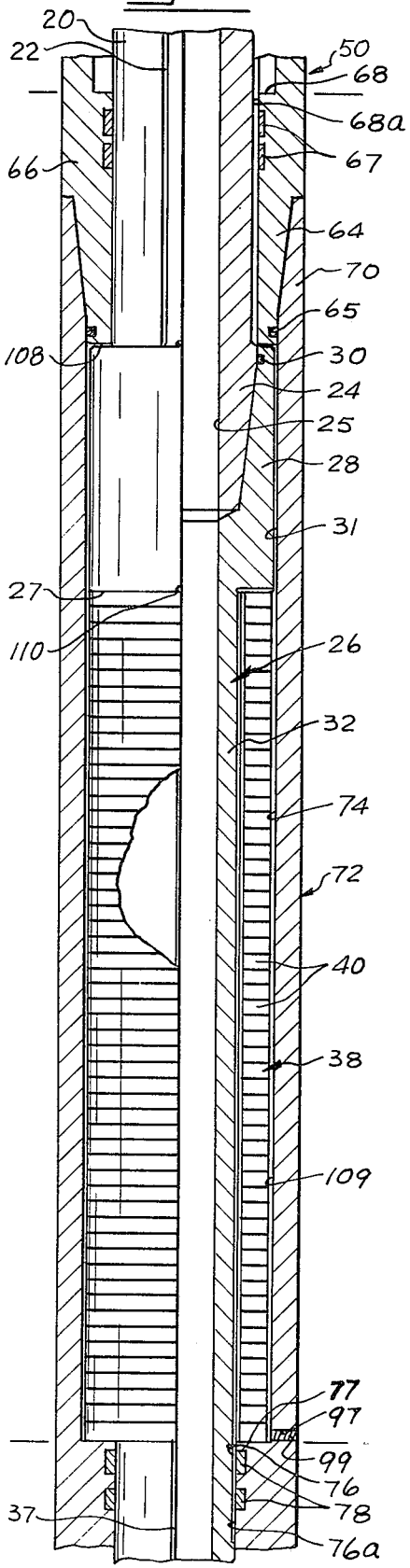
Figure 1C:
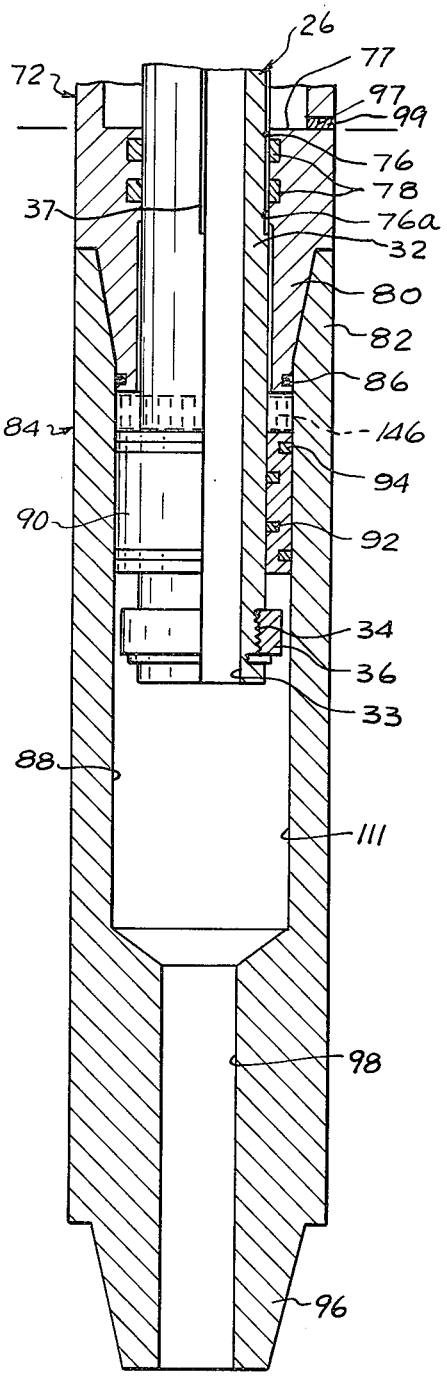

Referring to the Figures, in FIG. 1 is shown an embodiment of the present invention having a tubular barrel generally identified by reference numeral 10 and a tubular mandrel indentified as 12. The mandrel 12 is received within and is movable with respect to the barrel 10. The upper end of the mandrel 12 is in the form of a male spline member 13 which is provided with a box connection 14 of suitable tool joint design to connect to the drilling string (not shown). Below the box connection 14 is a section 16 of reduced diameter and below this is a length of male splines 18 cut into the surface of the mandrel. The splines 18 are chrome plated and finished to close tolerance. Below the splines 18 is a smaller diameter portion 20 having a close tolerance, chrome-plated surface having a plurality of flutes or grooves 22 cut into the surface thereof, said flutes extending along the roots of the male spline. As shown, the grooves 22 are linear and parallel to one another, although other configurations may be used. At the lower end of the spline member 13 is a pin connection 24. Down the center of the spline member 13 is a central bore 25 for carrying drilling mud through the tool to the drilling bit, not shown.

The next lower portion of the mandrel 12 is the wash pipe 26, the upper end of which is provided with a box connection 28 adapted to mate with the pin connection 24 of the male spline member 13. The wash pipe 26 has a reduced diameter portion 32 below the box connection 28, and together they form a compression shoulder 27. The box connection 28, is provided with an O-ring 30 to seal with the pin connection 24 of the male spline member 13. The box connection 28 is spaced from the barrel 10 to provide an annular passage 31. The shoulder 27 is provided with radially extending grooves 110, all for a purpose to be explained.

The reduced diameter portion 32 of the wash pipe 26 has threads 34 at its lower end threadably receiving nut 36. The reduced diameter portion 32 is of a size to be received in and support a plurality of deformable rings 38 making up the deformable element 40. The surface of the reduced diameter portion 32 is also provided with linear flutes or grooves 37 for a purpose to be explained. The reduced diameter portion 32 is also provided with a central bore 33, in communication with a bore 25, for carrying drilling mud to the tool bit.

The barrel 10 comprises at the upper end thereof a seal cap 42 having an axial bore or bearing surface 44 therein sized to receive the portion or mating bearing surface 16 of the male spline member 13 in close fitting relation — we provide a tolerance of about 0.002 inches. The inside surface of the seal cap bore 44 is provided with four circumferential grooves 45 in which are seated liquid-sealing rings **45*a* and hard stabilizing rings 45*b*. The seal cap 42 provides a liquid-tight seal with the chrome portion 16 of the male spline member and stabilizes the barrel 10 on the mandrel 12. Also provided as a sweeper ring 45*c*. The portion 16 has an interference fit in the stabilizing rings 45*b*. The lower end of the seal cap 42 is provided with a pin connection 46 which mates with a box connection 48 on the upper end of the female spline barrel section 50. An O-ring 52 seals the threaded connection. The female spline barrel section 50 has an internal bore 54 having female splines 56 cut into the surface thereof. The splines 56 are sized to mesh with the male splines 18 of the male spline member 13.**

Figure 5:
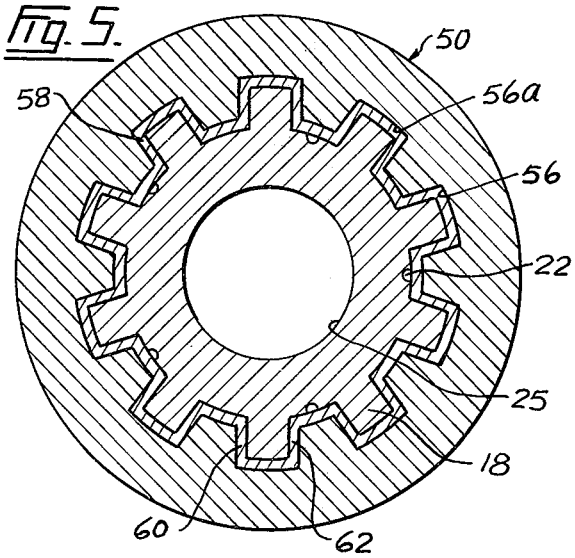
FIG. 5 is a view in cross section along line 5—5 of FIG. 2*a;*
Figure 8:
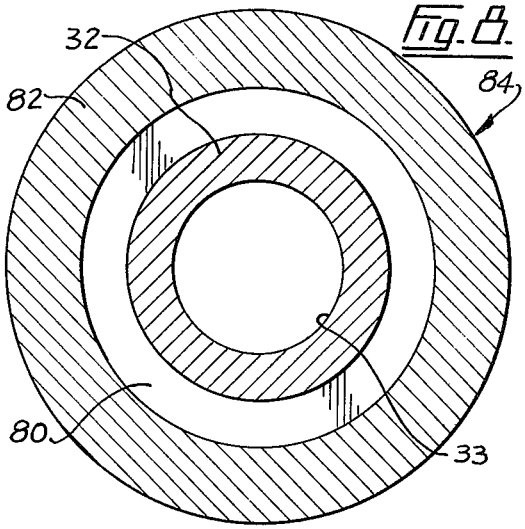
FIG. 8 is a view in cross section along line 8—8 of FIG. 2*c;*

As shown in FIG. 5, the female splines 56 are preferably provided with a steel core **56*a* onto which is moulded a synthetic coating layer 58 possessing superior wear and abrasion resistance, and which offers a cushioning effect to the torsional meshing of the splines. A suitable coating layer 58 is formed of a molybdenum disulphide-filled urethane composition having a shore D hardness of 50. The material is applied to provide a quarter inch thick layer 60 on the leading (i.e. driving) edges of the splines and an eighth inch thick layer 62 on the trailing (backlash) edges — see FIG. 5.**

The lower end of the female spline barrel section 50 is provided with a pin connection 64 carrying an O-ring 65 to provide a seal. The lower portion 66 of the bore 54 is of reduced diameter forming a shoulder 68 delineating a seal and bearing surface **68*a* journalling the lower end portion or mating bearing surface of the male spline member 13 therein. Several stabilizer rings 67 are provided in bore portion 66** to provide stabilization.

The pin connection 64 of the barrel section 50 is seen to mate with a box connection 70 on the upper end of the deformable element barrel section 72. An inner bore 74 is provided in the barrel section 72. The bore 74 extends nearly to the lower end of the barrel section 72, where a bore 76 of reduced diameter is provided to form a compression shoulder 77. The bore 76 is of a size to receive the lower end of the wash pipe 32 in a journalled and stabilizing relation within the bearing surface **76*a*. Stabilizer rings 78 are mounted in grooves, cut into the wall of the barrel section 72, to provide a liquid-tight interface fit about the mandrel 12.**

The lower end of the barrel section 72 terminates in a pin connection 80, which mates with a box connection 82 formed in the upper end of the pressure ring sub 84. An O-ring 86 is provided in the pin connection 80 to seal the threaded connection.

The pressure ring sub 84 is provided with a chromed, axial bore 88 of a diameter larger than the lower end of the wash pipe 26. Ring 90 is provided with O-rings 92 and 94 to provide a liquid-tight seal with the surface of bore 88 of the pressure ring sub 84 and the exterior surface of the reduced diameter portion 32 of the wash pipe 26. The annular ring 90 is retained on the wash pipe 26 by means of nut 36. The lower end of the pressure ring sub 84 is provided with a pin conection 96 for connection back into the lower end of the drilling string, not shown. The bore 88 has a reduced diameter portion 98 in the lower part of the pressure ring sub 84, for a purpose to be explained.

A port 97 is provided in the wall of the deformable element barrel section 72. The port 97 is closed by plug 99, which may be removed to permit the insertion of hydraulic fluid or the like into the interior of the tool, as will be explained. A similar port 101 and plug 103 are provided in the upper end of the female spline barrel section 50.

Figure 6:
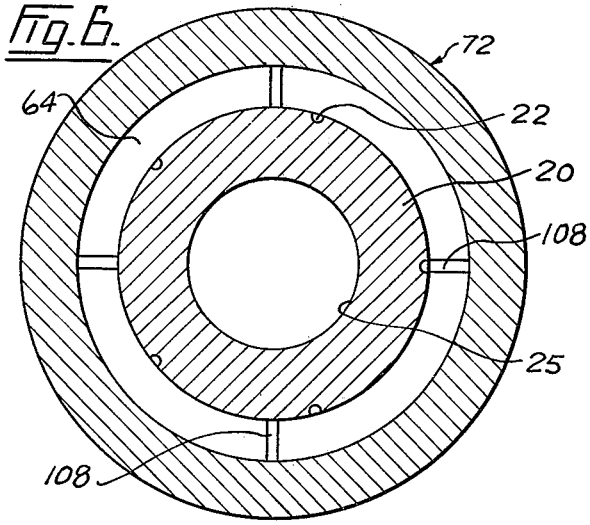
FIG. 6 is a view in cross section along line 6—6 of FIG. 2*b;*
Figure 7:
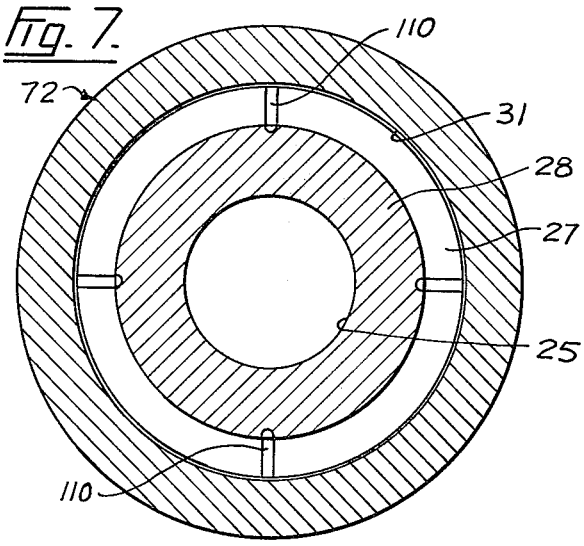
FIG. 7 is a view in cross section along line 7—7 of FIG. 2*b;*

Referring now to FIG. 5, a groove 22 is provided longitudinally in the land of every second spline, as also seen in FIG. 6. Also shown in FIG. 6 are oil passage grooves 108 across the pin 64 of the female spline. Referring to FIG. 7, the grooves 110 are shown across the shoulder 27 of the box connection 28 of wash pipe 26. It will be seen that the rings 45 between the spline member section 16 and the seal cap 42 form one stabilizer pair. The rings 67 between spline barrel section 50 and male spline section 13 form another stabilizer pair. The rings 78 between the lower end of the barrel section 72 and the wash pipe 26 form a third stabilizing zone, while the seal ring 90 provides still another stabilizer between the pressure ring sub 84 and the lower end of the wash pipe 26. All of these stabilizing structures tend to tie the barrel 10 and mandrel together laterally and stiffen the tool.

An annular space 107*a* is defined between the outer surface of the mandrel 12 and the inner surface of the barrel 10. The ends of this space 107a are closed by the liquid tight seals 45, 92, 94. The stabilizer rings 67, 78 sub-divide the annular space 107a into an internal spline chamber 107, deformable element chamber 109, and floating seal chamber 111, respectively. The space 107a is filled with the deformable segments 38 and operating fluid. The fluid can move freely between chambers 107 and 109 via grooves 22, 108 and 31 and between chambers 109 and 111 via annular passage 31 and grooves 110 and 37. It will be noted that the deformable segments 38 are discrete — that is, they are not permanently connected to the mandrel or barrel.

Figure 9:
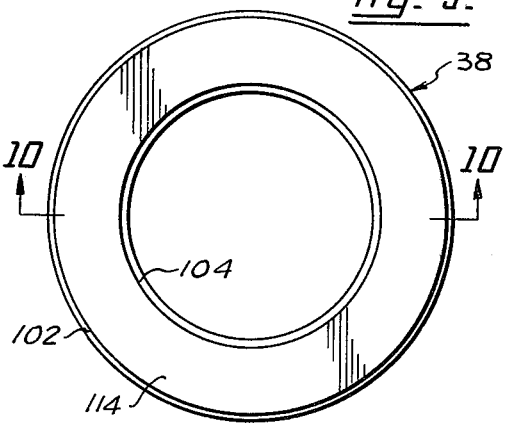
FIG. 9 is a plan view of one type of compressive element used in the damper of the present invention.
Figure 10:
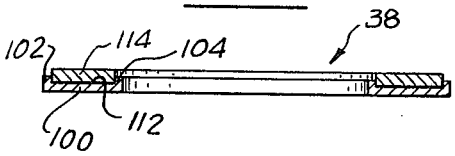
FIG. 10 is a view in section along line 10—10 of FIG. 9.

FIGS. 9 and 10 illustrate one form that the deformable segments 38 may take, in plane and section. The deformable segment 38 of FIG. 9 comprises a recessed metal washer 100 having a pair of upstanding ribs 102 and 104 defining an annular recess 112 therebetween. An annular ring 114 of an elastomer, having a thickness greater than the upstanding dimension of ribs 102 and 104, is positioned within the recess 112. The elastomer ring 114 deforms under pressure, but being resilient resumes its original shape when the pressure is relieved. It will further be noted that the deformable means, that is the rings 114, are operative in the tool to absorb load substantially uniformly throughout their length.

Figure 11:
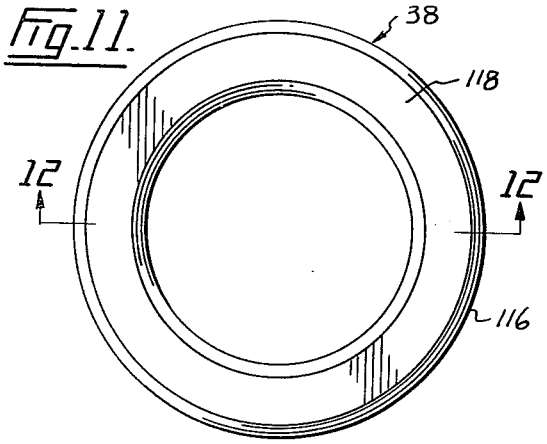
FIG. 11 is a plan view of another type of compressive element.
Figure 12:
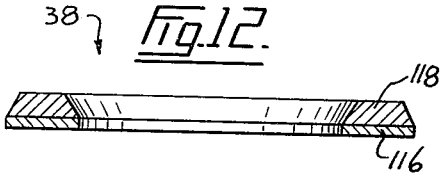
FIG. 12 is a view in section along line 12—12 of FIG. 11.

The deformable segment of FIGS. 11 and 12 is seen to comprise a flat metal washer 116 to which is attached by suitable means an annular ring 118 of elastomer having a cross section of a trapezoid with the major base contacting the metal washer 116.

Figure 13:
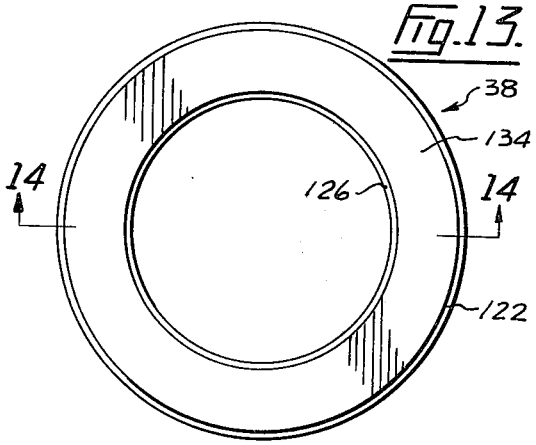
FIG. 13 is a plan view of still another type of compressive element.
Figure 14:
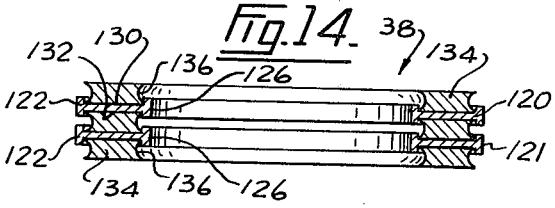
FIG. 14 is a view in section along line 14—14 of FIG. 13.

The deformable segments of FIGS. 13 and 14 are seen to comprise the metal washers 120 and 121, each washer having an outer rib 122 and an inner rib 126, respectively defining annular recesses 130 and 132. An annular ring 134 of an elastomer is positioned in each recess and sandwiched between adjacent washers. The side surfaces 136 of the elastomer rings 134 are of concave shape, to failitate seating and retention within the recesses of the washers.

Figure 15:
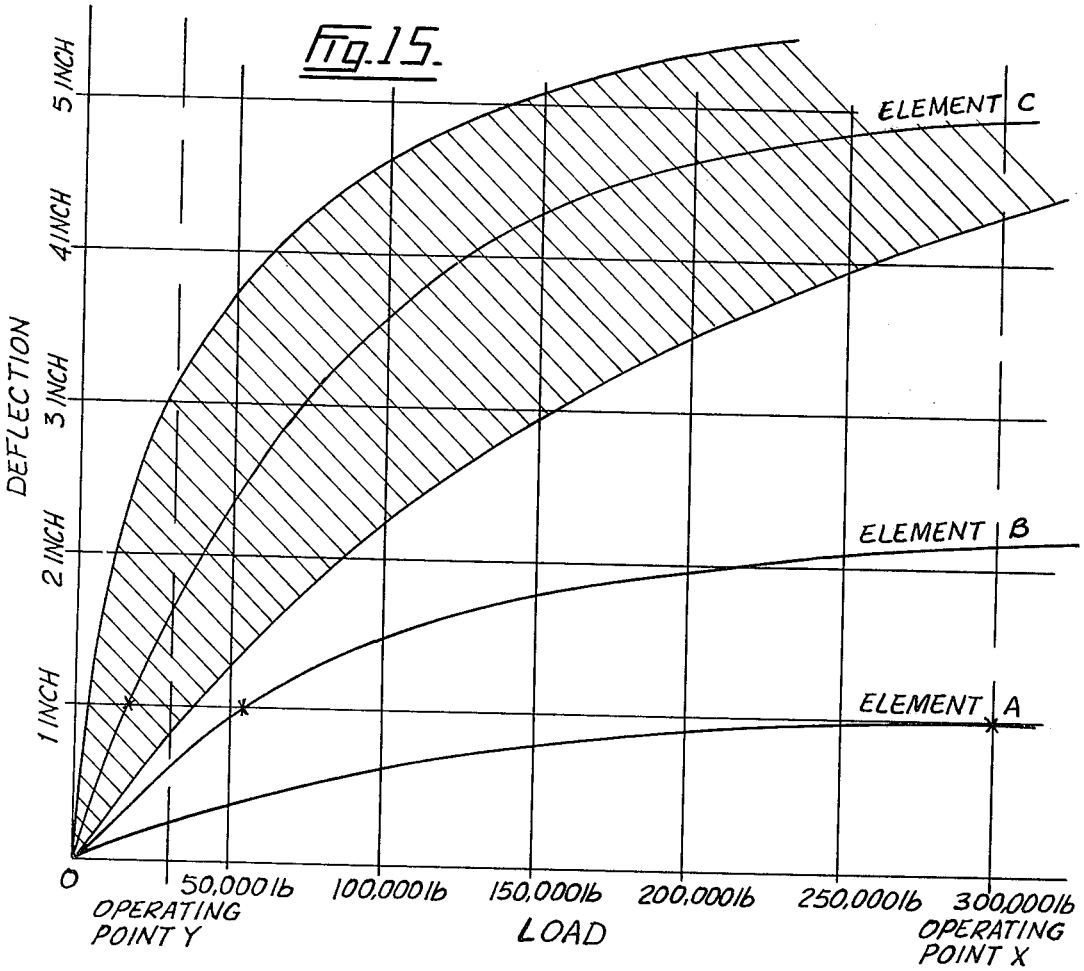
FIG. 15 is a graph showing the spring rate characteristics of "soft," "moderate" and "hard" deformable elements.

The design of each of these deformable segments is such that at low loads, deflection of the tool is higher than it is at high loads. The performance characteristics of the deformable element preferably falls within the shaded band shown in FIG. 15.

It is contemplated that other elastomers, such as rubber, silicone rubber and neoprene, as well as urethane, may be used in the deformable element. It is also contemplated that a hard non-metallic washer may be used instead of metal washers, or that a single deformable body, instead of a stack of alternating metal and elastomer segments, may be used.

It will be seen in FIG. 1b that the shoulder of the box connection 28 on the mandrel 12 contacts the shoulder of the barrel pin 64 to limit the telescoping action of the mandrel and barrel and prevent them from coming apart.

In operating the damper, the pin connection 96 on the pressure ring sub 84 is screwed into the drill bit while the box connection 14 of the male spline 16 is screwed into the collars or stabilizers on the bottom of the drilling string. The tool is designed to operate under conditions encountered in the drilling industry in shallow or deep wells and in rough or smooth drilling. For example, when the damper is used directly above the bit in a deep hole in a rough drilling application, under the following conditions,

| | |
|---|---|
| hydrostatic head | = 10,000 psi |
| pressure drop across bit | = 1,000 psi |
| bit weight | = 55,000 pounds |
| total string weight | = 105,000 pounds |
| vertical bit motion | = ± ½ inch |
| rotary speed | = 60 rpm |

it will operate as follows.

The fully extended tool is lowered into the well bore on the drilling string, until the bit is on bottom. The internal pressure within the annular space 107*a* equalizes with the 10,000 psi pressure at the bottom of the well bore, arising from the head of fluid standing therein, as said bottom hole pressure biases the floating seal ring 90 upwardly. Weight is then set on the bit, thereby loading the tool. The element segments 38 are deformed by the compression shoulders 27, 77 as the mandrel 12 and barrel 10 telescope together. The rig's mud pump is then kicked in, increasing the pressure internal of the drilling string at the tool by 1,000 psi. When this occurs, the load on the element segments 38 is reduced due to the pressure, attributable to the pump, acting against the cross sectional area of the wash pipe 26 and the male spline member 13. This pressure will tend to pump the tool open — in the typical case where the area is 30 square inches, the pumpapart force will amount to 30,000 pounds for the example conditions which we have choosen hereinabove. Thus the load on the element segments will be reduced from 55,000 pounds to 25,000 pounds, although the bit is still loaded with 55,000 pounds.

The drill string is then caused to rotate. As rotation occurs and the bit moves vertically perhaps plus or minus ½ inch about a median point at a frequency of 3 cps, the deformable element 40 is compressed and expanded ½ inch (for a total movement of 1 inch) at that frequency. More particularly, the urethane rings 114 are deformed, forcing operating liquid through the flutes 37, in the wash pipe reduced diameter section 32, into the floating seal chamber 111, thereby downwardly biasing the floating seal ring 90. Since the spring rate of the element at this loading is preferably about 20,000 pounds/inch, the load on the deformable element 40 during these deflections will vary between about 15,000 and 35,000 pounds. The net effect is that the bit load will vary from about 45,000 to 65,000. As the tool compresses and expands, the operating oil is pumped back and forth between the chambers, thus absorbing energy.

The design of the vibration damper of this invention is such as to: (1) provide equalization of the pressure within the deformable element chamber with the bottom hole hydrostatic pressure, to eliminate the problem of pre-loading; (2) provide a differential seal area, so that the rig's pump pressure, as reflected at the tool, operates to pump the mandrel and barrel apart, thereby preserving the most flexible portions of the tool stroke for the absorption of the axial thrusts of the bit; (3) provide a soft deformable element, preferably having spring rate chracteristics such that the tool will telescope at least 2 inches when loaded with 80,000 pounds, and not more than two inches when loaded with 10,000 pounds, to ensure that the greatest part of the cyclic loading arising from the drill bit movement is taken up by the tool; (4) provide stabilization of the tool in an effort to minimize hole deviation; (5) provide deformable segments which are spaced from the moving walls of the element chamber a sufficient distance to permit deformation of the urethane rings to occur without contact with the walls; (6) provide damping of the telescopic movements by arranging for the operating oil to have to pass back and forth across the liquid-tight bearing zones through restricted flutes having a pre-selected cross-sectional area; and (7) provide an improved spline assembly adapted to cope with the relatively longer stroke and high frequency telescoping of the tool.

Figure 2A:
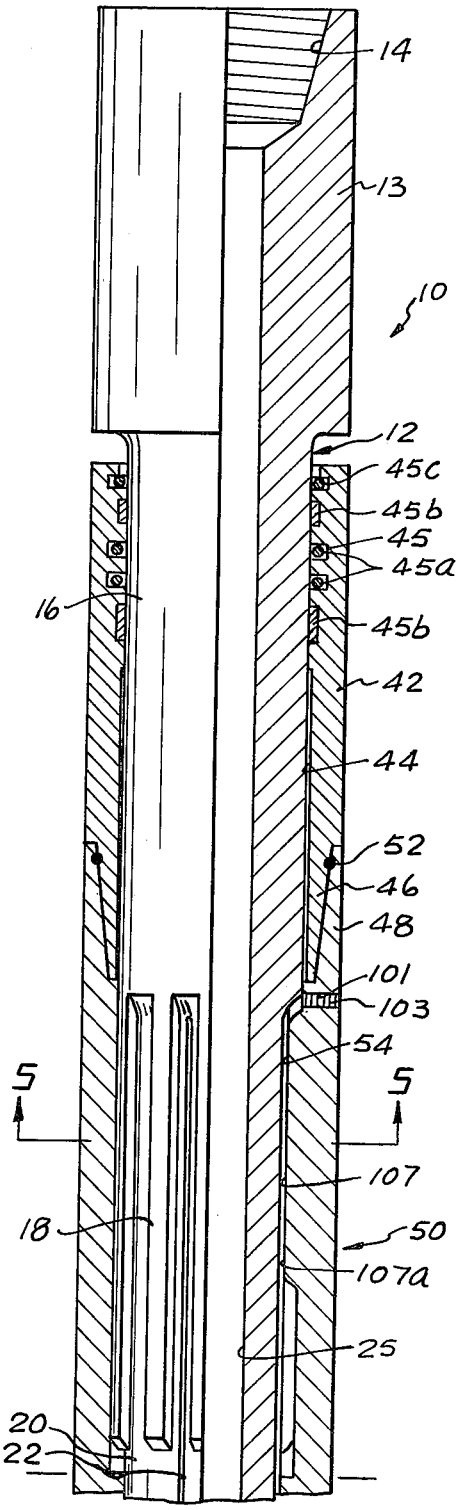
FIGS. 2*a*, 2*b* and 2*c* are views in elevation similar to FIG. 1 of the damper in a compressed or loaded condition.
Figure 2B:
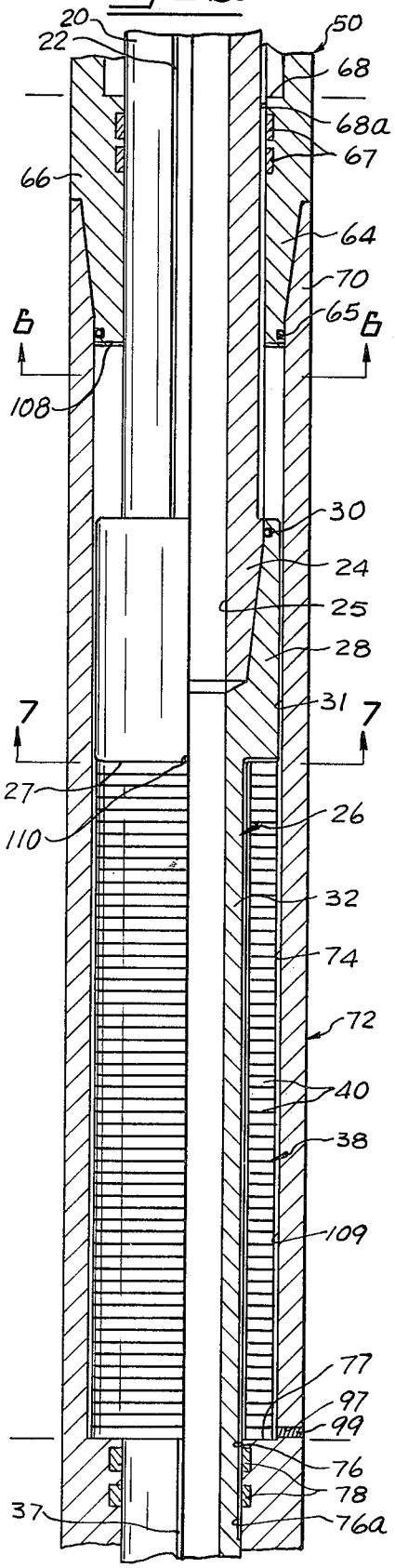
Figure 2C:
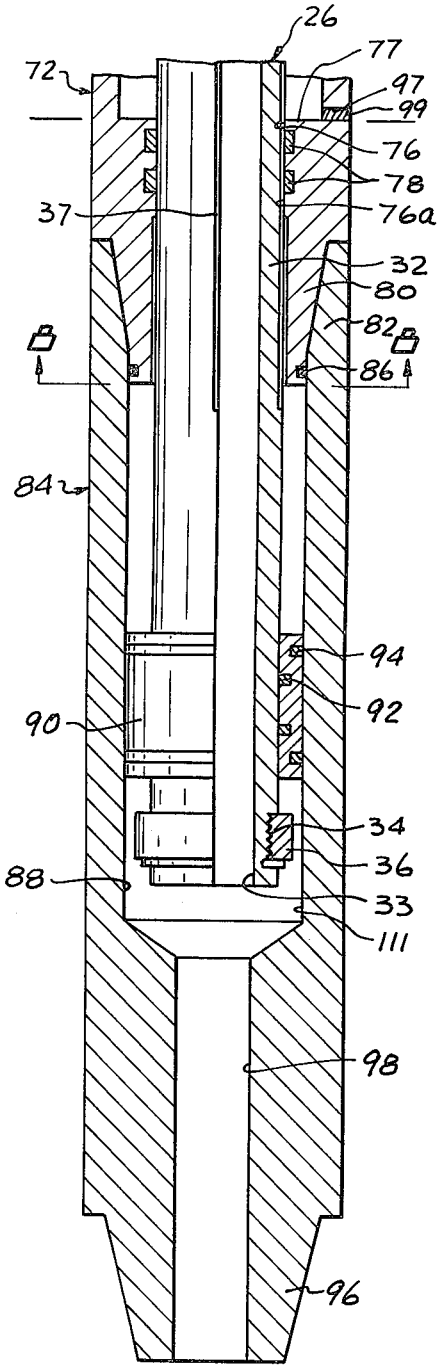
Figure 3A:
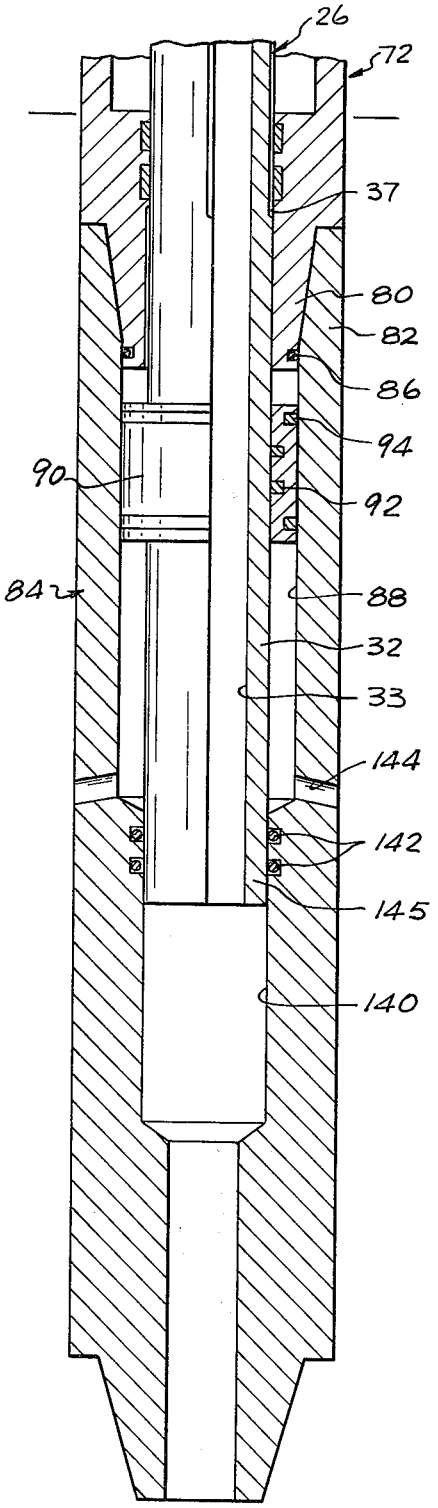
FIG. 3*a* is a view in elevation of the lower portion of another embodiment of the drill string vibration damper in the unloaded condition.
Figure 3B:
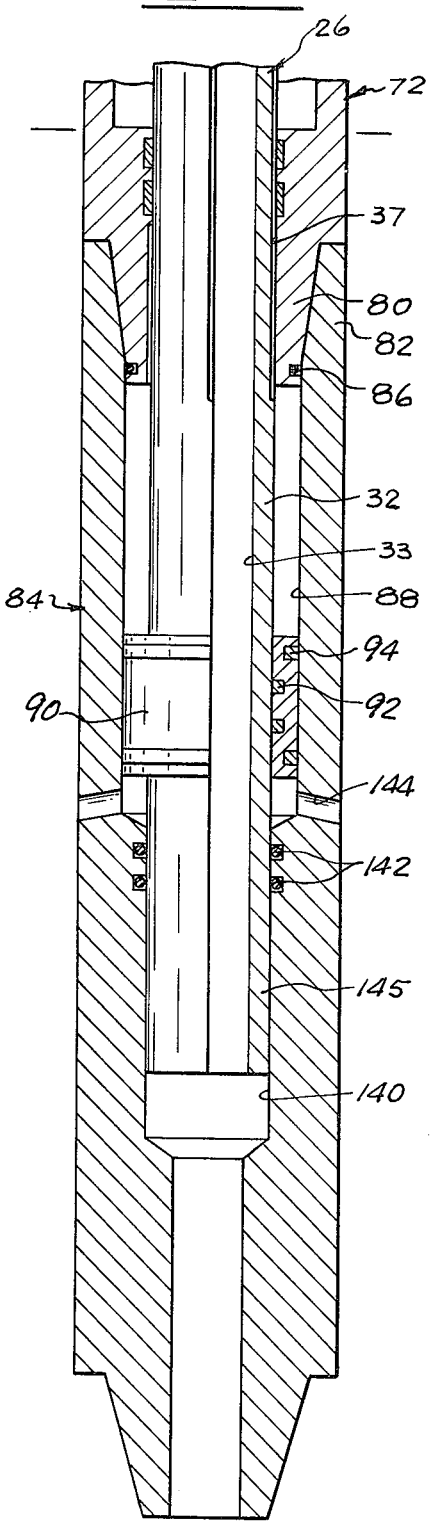
FIG. 3*b* is a view of the embodiment of FIG. 3*a* in the loaded condition.

Referring now to FIGS. 3*a* and 3*b*, there is shown another embodiment wherein the configuration of the lower end of the wash pipe 26 and the pressure ring sub 84 is modified. It will be noted that the bore 88 of the pressure ring sub 84 connects to a bore 140 of intermediate diameter of a size to receive the reduced diameter portion 32 of wash pipe 26 in close fit relation. A pair of seals 142 are provided at the upper end of bore 140. One or more openings 144 are provided through the side walls of pressure ring sub 84 to communicate the outside thereof with the lower portion of bore 88. The threads 34 and nut on the lower end of the wash pipe 26 are eliminated and the reduced diameter portion 32 is provided with an extension 146 to be received within the bore 140 and to be lapped by seals 142 in the unloaded condition. FIG. 3*b* shows the damper under loaded condition. In this configuration, the pressure ring 90 is subjected to well bore pressure rather than internal string pressure. The result of this configuration is that fluid in the inner chambers of the damper is maintained at well bore pressure, consequently the differential pressure across the bit acts only on the cross sectional area of wash pipe extension 146. Thus the force pumping the damper open is significantly reduced over that necessary with the embodiment of FIGS. 1 and 2 while maintaining the pressure equalization feature. This configuration is particularly useful in large diameter tools used in shallow holes where bit weight may not be substantially greater than the force generated by differential pressure on the pressure ring area.

Figure 4A:
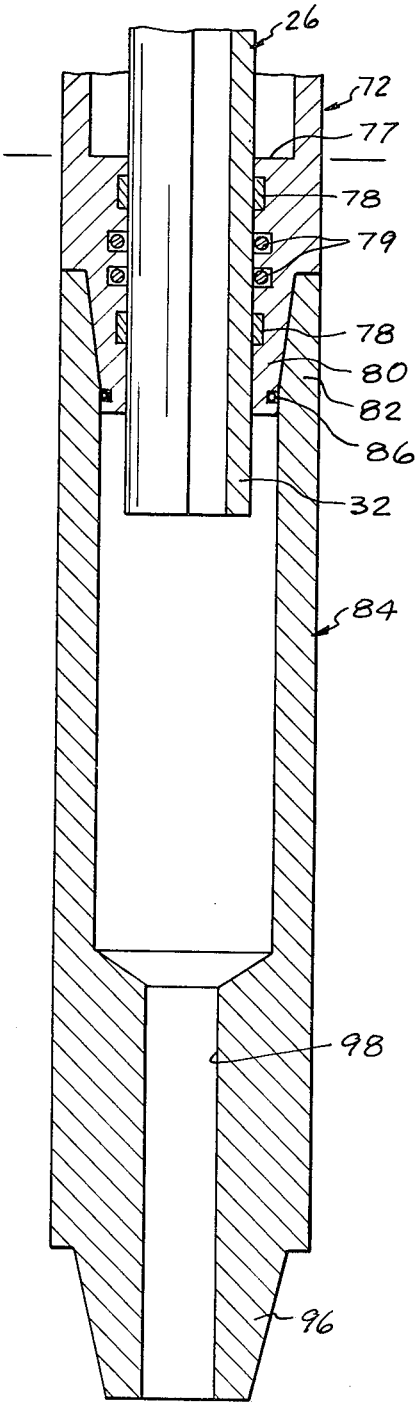
FIG. 4*a* is a view in elevation of the lower portion of still another embodiment of the drill string vibration damper in the unloaded condition.
Figure 4B:
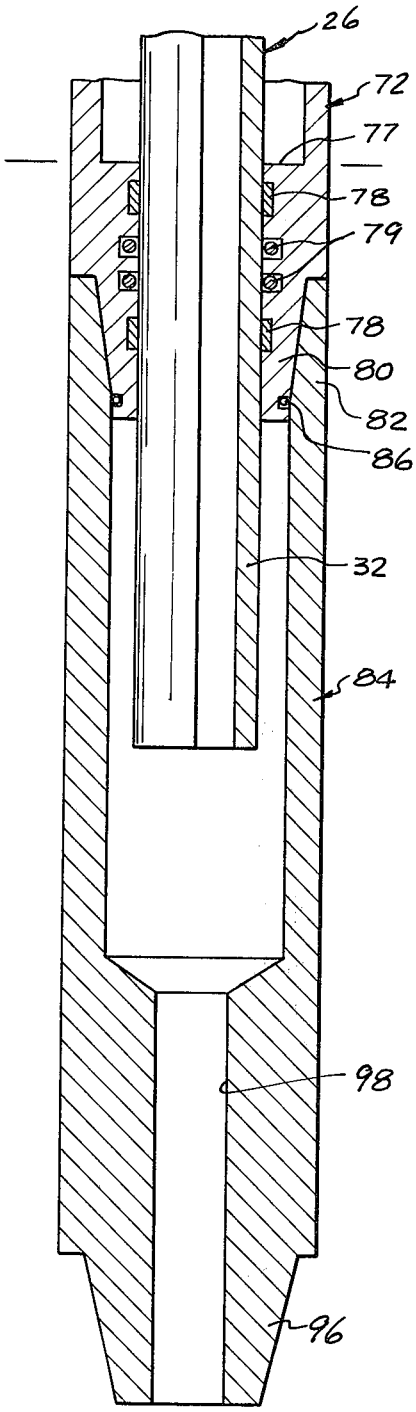
FIG. 4*b* is a view in elevation of the embodiment of FIG. 4*a* in the loaded condition.

FIGS. 4*a* and 4*b* show a damper configuration absent the pressure ring 90 and grooves 37 and does not allow for equalization of internal and external pressures. In this configuration the damper is underfilled with fluid and is particularly useful in large diameter shallow holes. Additional stabilization is obtained by the use of stabilizer rings 78 both above and below seals 79.

In the embodiment of FIGS. 1 and 2 it has been shown how the floating seal ring 90 equalizes the fluid pressure in the internal chambers with the mud pressure. Further it has been shown that the differential pressure across the drill bit acts on the floating seal ring 90 and mandrel to pump the damper open with a force equal to the differential pressure times the area enclosed by the outside diameter of the pressure seal ring.

As may occur in some cases, the area enclosed by the outside diameter of the pressure seal ring times the differential pressure may be in excess of the load to be carried on the bit. In this case the damper would remain pumped open and would not function as intended. In such case, the pressure seal ring is not permitted to float. This is accomplished by placing an elastomer spacer 146, shown dotted, between the pressure seal ring and the pin 80 of the compressive element barrel section 72. In addition, the damper is only partially filled with fluid. Thus, the hydrostatic pressure holds the pressure seal ring against the spacer 146, while the wash pipe moves axially through the seals on 94 the inside diameter of the pressure ring 90. The result is that no pressure equalization is present in the annular chamber of the damper which results in the hydrostatic head pumping the damper closed. The differential pressure across the bit, however, acts on the area of the mandrel 32 attempting to pump the tool open. Thus the damper according to this invention can be modified for use in shallow holes simply by adding the spacer 146 and underfilling the internal chamber.

Obvious variations in the specific constructional details described may be made without departing from the spirit of the invention and such embodiments of the invention as come within the scope and purview of the appended claims are to be considered as part of this invention.

What is claimed is:

1. A tool for use in a drill string utilizing drilling fluid to drill a well bore and having utility for absorbing shock loading arising from axial displacement of an attached drilling bit, said tool comprising:

telescopically arranged tubular parts comprising an outer barrel and an inner mandrel received in the barrel in spaced relationship therewith so that a space is formed therebetween, said barrel and mandrel being movable longitudinally relative to each other;

means at the outer ends of the parts for threadably connecting them into the drill string;

means carried by said parts for limiting their relative longitudinal movement;

said tubular parts comprising means connecting them for rotation together while permitting telescopic movement;

discrete, resilient, solid, temporarily deformable means disposed in the space, said means having a spring rate of less than 100,000 pounds per inch and being substantially out of contact at all times with the barrel and mandrel side walls;

a pair of opposed compression means, one such means being carried by the mandrel and extending into the space adjacent one end thereof, the other such means being carried by the barrel and extending into the space adjacent the other end thereof, said compression means being adapted to act against the ends of the deformable means;

a body of operating liquid disposed in the space with the deformable means;

substantially liquid tight means, at each end of the space, between the mandrel and barrel, for preventing well bore drilling fluid from mixing with the operating liquid; and means for pressurizing the operating liquid to substantially equalize it with the hydrostatic bottom hole pressure.

2. The tool as set forth in claim 1 wherein:

the space is annular; and the deformable means comprises a stack of solid, annular elements whose side surfaces are spaced from the inner surface of the barrel and outer surface of the mandrel.

3. The tool as set forth in claim 1 wherein:

the deformable means is adapted to permit at least two inches of telescoping tool movement when the tool is axially loaded with 80,000 pounds and not more than two inches of telescoping tool movement when axially loaded with 10,000 pounds.

4. The tool as set forth in claim 3 wherein:

the space is annular; and the deformable means comprises a stack of solid, annular elements whose side surfaces are spaced from the inner surface of the barrel and outer surface of the mandrel.

5. The tool as set forth in claim 3 wherein:

the deformable means is substantially non-metallic.

6. The tool as set forth in claim 5 wherein:

the space is annular; and the deformable means comprises a stack of solid annular elements whose side surfaces are spaced from the inner surface of the barrel and the outer surface of the mandrel.

7. The tool as set forth in claim 6 wherein:

one or more fixed seals are carried by one of the parts at one end of the space for preventing well bore drilling fluid from mixing with the operating liquid; and a floating seal member is provided at the other end of the space, said member comprising an annular body slidable on the mandrel and seals carried by the body at its outer surface for preventing well bore drilling fluid from mixing with the operating liquid, said floating seal member being operative to pressurize the operating liquid to substantially equalize it with the hydrostatic bottom hole pressure.

8. The tool as set forth in claim 3 wherein:

the liquid tight means include one or more fixed seals which are carried by one of the parts at one end of the space for preventing well bore drilling fluid from mixing with the operating liquid; and wherein the means for pressurizing the operating liquid includes a floating seal member and is provided at the other end of the space, said member comprising a body slidable on the mandrel and seals carried by the body at its outer surface for preventing well bore drilling fluid from mixing with the operating liquid, said floating seal member being operative to pressurize the operating liquid to substantially equalize it with the hydrostatic bottom hole pressure.

9. The tool as set forth in claim 8 wherein:

the space is annular; and the deformable means comprises a stack of solid, annular elements whose side surfaces are spaced from the inner surface of the barrel and outer surface of the mandrel.

10. The tool as set forth in claim 9 wherein:

the annular elements are formed of urethane.

11. The tool as set forth in claim 9 wherein:

the stack of annular elements is of sufficient length so that it can accomodate the movement of the bit;

the barrel has a plurality of spaced bearing surfaces which each co-act with a mating bearing surface on the mandrel to provide a close fit therewith to stabilize the mandrel; and said tool further comprises means providing communication across the bearing portions whereby operating liquid may move back and forth through said means past said bearing portions.

* * * * *